72-68 S9
10/15/85 OR 4,546,630

United States Patent [19]

Sakamura

[11] Patent Number: 4,546,630

[45] Date of Patent: Oct. 15, 1985

[54] FORMER HAVING CONTINUOUS FORMING-ROLLING ASSEMBLY

[76] Inventor: Yoshikazu Sakamura, 56, Kitamomodani-cho, Minami-ku, Osaka-shi, Japan

[21] Appl. No.: 525,674

[22] Filed: Aug. 23, 1983

[51] Int. Cl.[4] ..... B21D 43/05

[52] U.S. Cl. ..... 72/68; 72/405; 72/92; 10/12 T

[58] Field of Search ..... 72/68, 92, 339, 356, 72/404, 67, 105, 106, 405; 10/4, 11 T, 12 T

[56] References Cited

U.S. PATENT DOCUMENTS

| | | | |
|---|---|---|---|
| 959,825 | 5/1910 | Warwick | 72/68 |
| 1,892,445 | 12/1932 | Burbank | 10/12 T |
| 2,108,709 | 2/1938 | Frayer | 10/11 T |
| 2,162,891 | 6/1939 | Johnson | 10/4 |
| 3,418,012 | 12/1968 | LaTorre | 403/408 |
| 3,691,806 | 9/1972 | Hanzawa | 72/92 |
| 3,731,511 | 5/1973 | Matej et al. | 72/92 |
| 4,084,278 | 4/1978 | Allebach et al. | 72/405 |
| 4,397,170 | 8/1983 | Seebach, Jr. | 72/68 |

FOREIGN PATENT DOCUMENTS

| | | | |
|---|---|---|---|
| 55-120443 | 9/1980 | Japan | 72/356 |
| 58-21126 | 4/1983 | Japan . | |

*Primary Examiner*—Lowell A. Larson
*Attorney, Agent, or Firm*—Wenderoth, Lind & Ponack

[57] ABSTRACT

A press assembly by which cut metal workpieces of specified length are formed into blanks of desired shape by punches and dies is provided with a rolling mechanism disposed adjacent to and in line with the press assembly. The blanks formed by the press assembly are fed directly to the rolling mechanism to perform the press work and rolling work continuously.

2 Claims, 9 Drawing Figures

FORMER HAVING CONTINUOUS FORMING-ROLLING ASSEMBLY

BACKGROUND OF THE INVENTION

The present invention relates to a former which comprises a press assembly of punches and corresponding dies for pressing metal workpieces into bolts, nuts or other metal parts multistepwise successively more closely to the desired dimensions thereof, and more particularly to a novel and useful apparatus of this type wherein the press assembly is provided with a rolling mechanism operable in timed relation therewith as for threading, to perform press work and rolling work by a continuous process fully automatically.

For example, when bolt blanks are formed with the use of a multi-stage press former by cutting a metal material to a predetermined length and subjecting the cut workpieces to preliminary and several subsequent steps of press work, it is usual practice to collect the blanks and then thread them by a separate process for finishing. However, when the blanks obtained by press forming are threaded by thread rolling as secondary work, there is a considerable interval of time as well as of distance between the press work and the thread rolling, so that there is a need to use a guide pipe, conveyor or the like for supplying the blanks to the rolling apparatus. While the blanks are being so conveyed to the rolling apparatus, the conveyance means can become plugged or like trouble is likely to occur, thereby hindering the smooth transfer of the blanks, resulting in an interruption in the process or accumulation of blanks, and therefore a reduced work efficiency. Presently, therefore, it is impossible to operate the apparatus reliably without an operator. Furthermore, the independent thread rolling apparatus needed for the secondary work must be large-sized, requires additional labor and makes the product costly to produce. Moreover, when thread rolling is resorted to, the thermal effect on the bolt blank is of importance, whereas the lapse of much time involved in the transfer from the press work process to the rolling process entails a drop of temperature, giving rise to difficulty in obtaining high-tension bolts which are resistant to fatigue.

SUMMARY OF THE INVENTION

An object of the present invention is to provide an apparatus which comprises a single multi-stage former having a press assembly, and a rolling mechanism disposed adjacent to and in line with the press assembly, and which is adapted to perform the overall process, from the press work process through the rolling process, continuously and fully automatically.

Another object of the invention is to reduce the time and space interval between the press work and the thread rolling work so that rolling work is performed immediately after press work, so that blanks can be rolled quickly and accurately in an optimum temperature range as required for rolling, to obtain high tension bolts which are inexpensive and resistant to fatigue.

Still another object of the invention is to provide an apparatus of the type described wherein the press assembly and the rolling mechanism are operable in synchronism to render the apparatus simple in construction, compact in its entirety, operable accurately without malfunction and durable.

DESCRIPTION OF THE PREFERRED EMBODIMENTS

Figure 2:
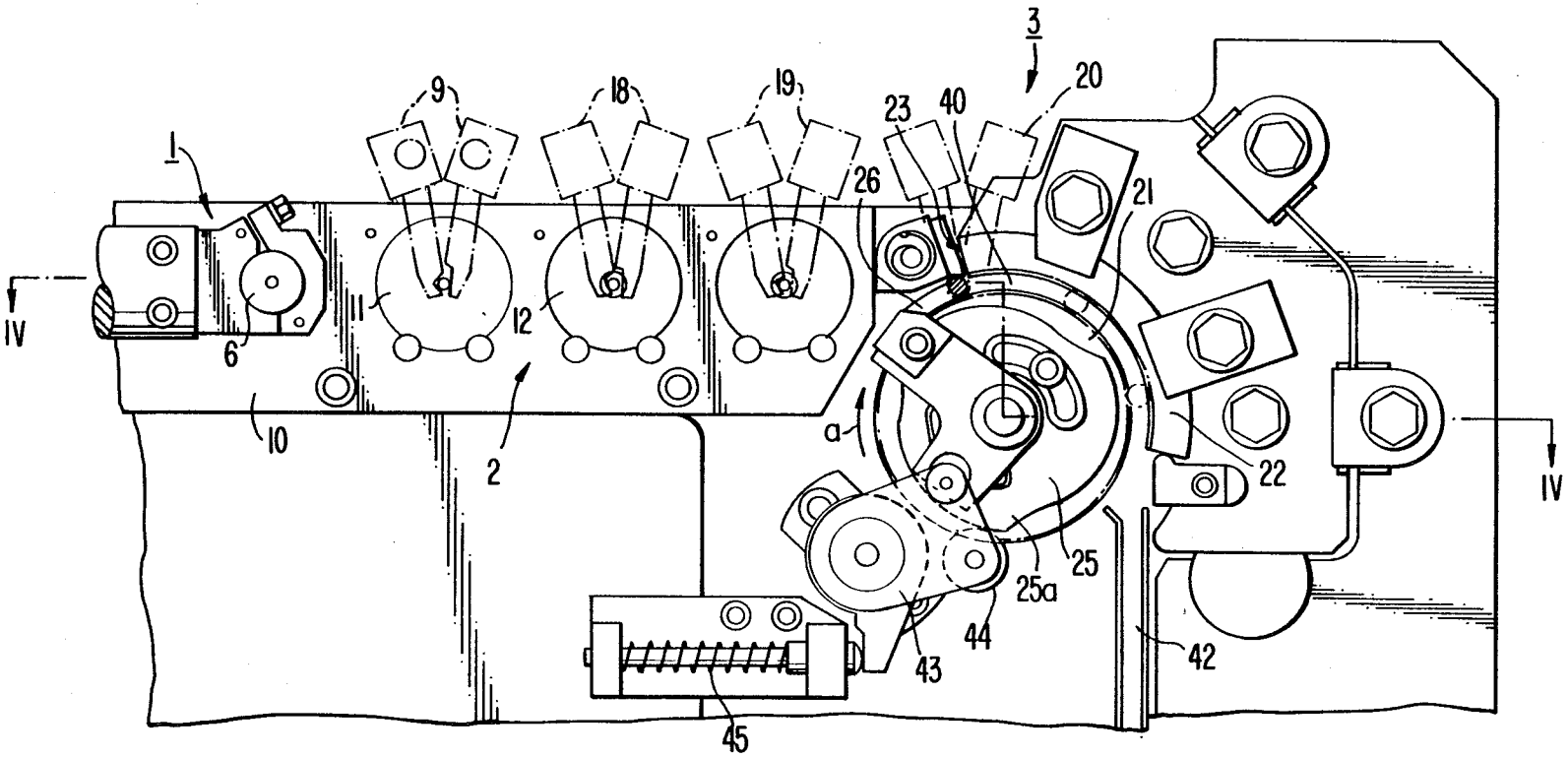
FIG. 2 is a front view showing a forming-rolling assembly as it is seen along the line II-II in FIG. 1.
Figure 3:
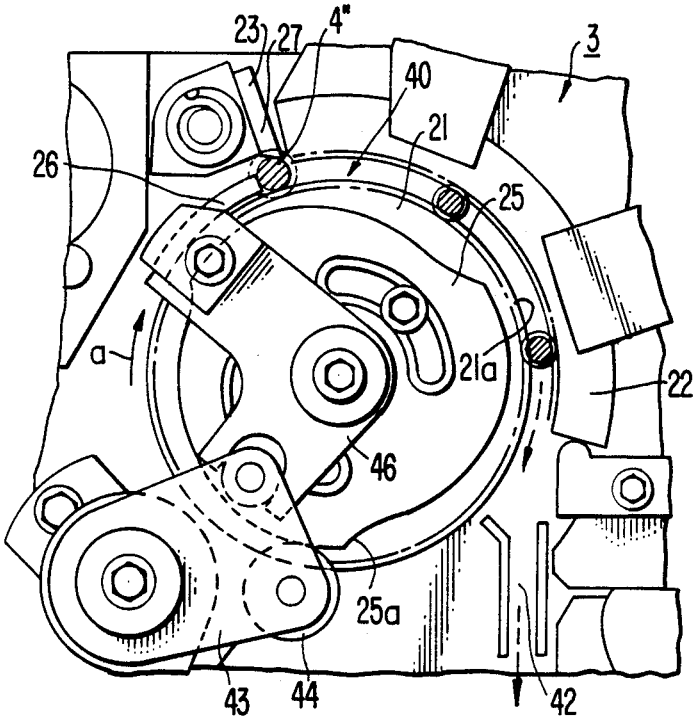
FIG. 3 is an enlarged front view showing the rolling mechanism.
Figure 4:
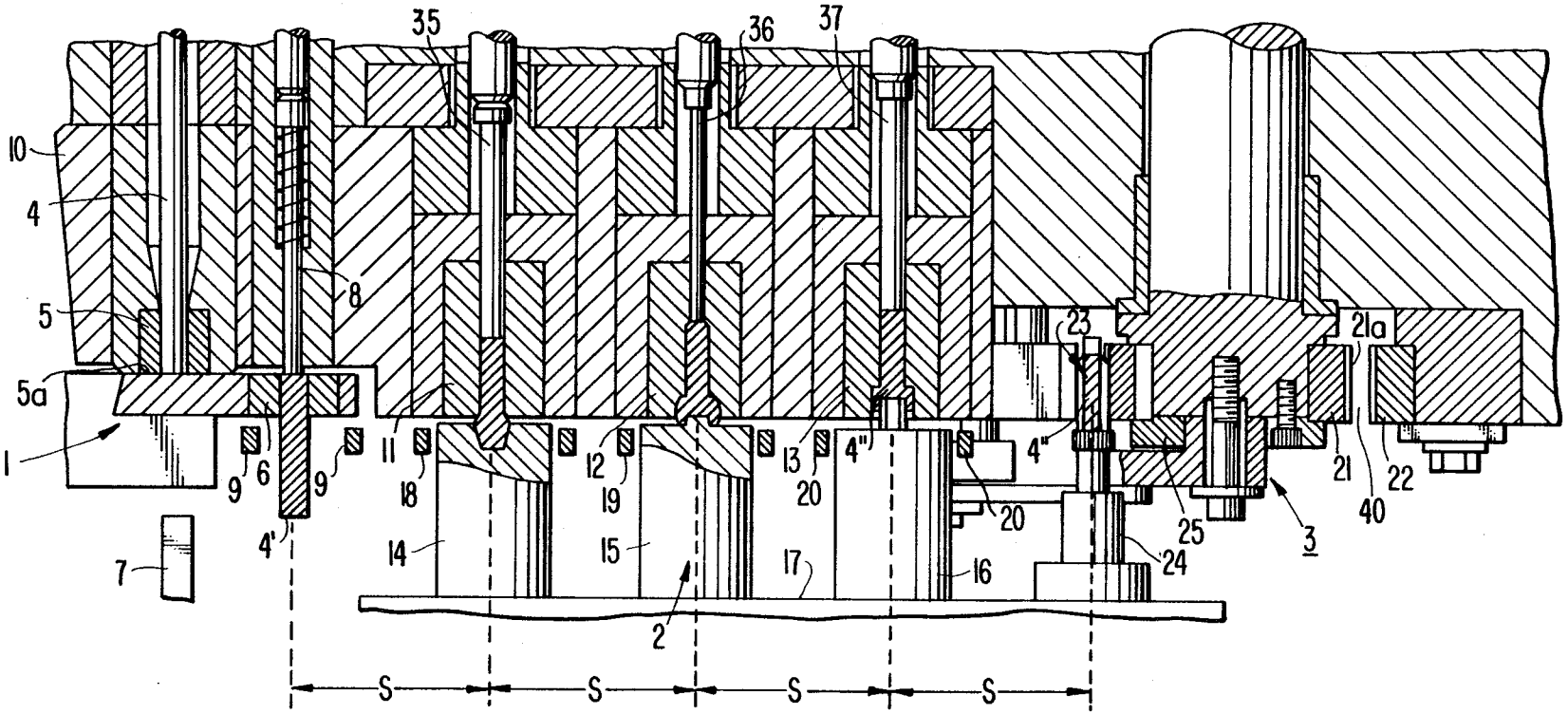
FIG. 4 is a plan view in cross section taken along the line IV-IV in FIG. 2.

With reference to FIGS. 2 and 4 showing an apparatus of the invention, the apparatus has a cutter 1 at left, a rolling mechanism 3 at right and a three-stage press assembly 2 therebetween.

A metal material 4 in the form of a wire rod or bar is intermittently moved out from the forward end opening 5*a* of a quill 5 so as to project from the opening a specified length (with use of an unillustrated feeder). The cutter 1 has a knife 6 which is reciprocatingly movable traversely of the quill end to cut the material 4 to the specified length. A stopper 7 is fixedly provided opposed to and spaced apart from the quill end opening. The workpiece 4' cut off is limited to the specified length by the striking contact of the forward end of the material 4 with the stopper 7.

The workpiece 4' as cut off by the movable knife 6 is forced rightward to a position where a pusher 8 is located, whereupon the pusher 8 forces out the workpiece 4' from the knife 6 into a first transfer chuck 9, which in turn grips the workpiece 4'.

The press assembly 2 comprises a plurality of dies 11, 12 and 13 mounted on a die block 10 and arranged in a planar row at a predetermined spacing, and punches 14, 15 and 16 mounted on a press ram 17 in corresponding relation to the dies. Disposed immediately in front of the dies are transfer chucks 18, 19 and 20 for chucking the press-formed workpiece 4' and transferring the same from stage to stage for every stroke of the press ram. Although multi-stage formers adapted specifically for usual press work do not include a transfer chuck for the terminal die, the apparatus of the invention additionally has the transfer chuck 20 for the terminal die 13 for transferring the resulting blank 4'' directly to the rolling mechanism 3 to be described below. The chuck is operatively connected to the other transfer chucks for cooperative operation.

The rolling mechanism 3, which is disposed adjacent to and in line with the terminal die 13 of the press assembly, comprises a rotatable cylindrical rolling die 21 having a threaded peripheral surface 21*a*, a stationary support rolling die 22 spaced apart from and opposed to a portion of the die periphery, a feed inlet 23 for the dies 21 and 22, and a pusher 24 mounted on the press ram 17 in alignment with the other punches. The feed inlet 23 is provided at an upper portion thereof with a starter lever 26 by which the blank 4'' inserted into the feed inlet 23 by the action of a cam 25 is pushed into a rolling portion 40 between the two rolling dies 21 and 22. The feed inlet 23 is further provided with a spring-biased stopper 27 for retaining the blank 4'' inserted in the inlet, whereby the blank 4'' is held in place unless it is pushed by the starter lever 26.

Figure 1:
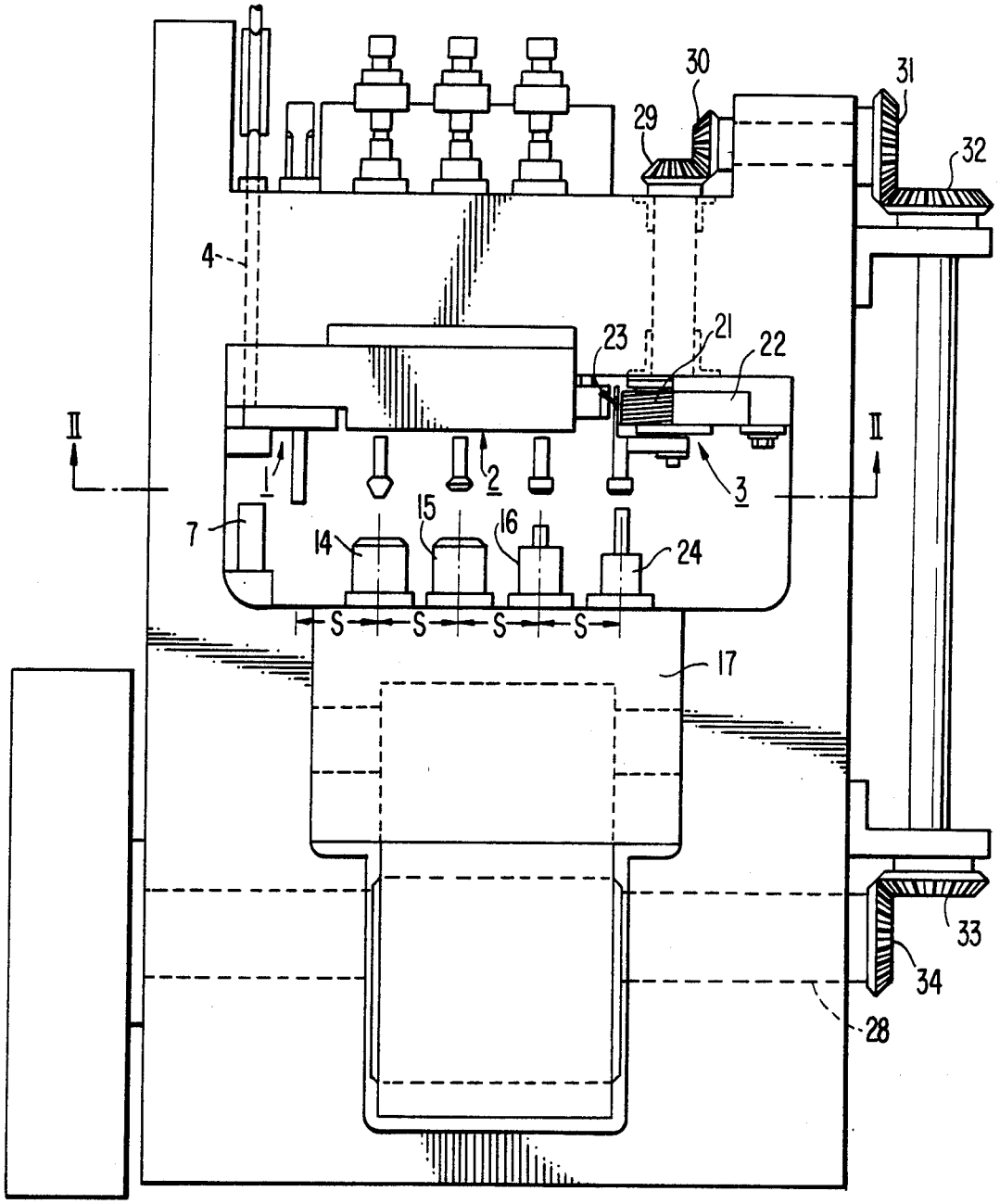
FIG. 1 is an overall plan view showing a former embodying the invention.

As shown in FIG. 1, the rolling die 21 is operatively connected to a drive-crank shaft 28 for the press ram 17 by a coupling means comprising bevel gears 29, 30, 31, 32, 33, and 34. During one reciprocating motion of the press ram 17, therefore, the rolling die 21 rotates in a clockwise direction (arrow a) in FIG. 2 with the motion, whereby the blank 4'' inserted in the inlet 23 is rolled for threading between the dies 21 and 22.

Every time the drive crank shaft 28 performs one turn of rotation, the press ram 17 brings through a crank motion the punches 14, 15, 16 and the pusher 24 into a forward and rearward reciprocating motion in unison. The rolling die 21 and the starter lever 26 are adapted to move in synchronism with and in predetermined relation to the reciprocating motion.

When the metal material 4 is moved out from the forward end opening 5*a* of the quill 5 into bearing contact with the stopper 7 in the above arrangement, the movable knife 6 moves from left to right in FIGS. 2 and 4 to cut the material 4 and push the cut workpiece 4' rightward to a position immediately before the pusher 8. The pusher 8 then advances to push out the cut workpiece 4' from the knife 6, whereupon the workpiece 4' is gripped by the first transfer chuck 9 in a standby position and is brought to a position immediately before the first die 11 while the press ram 17 is retracted. Subsequently the press ram 17 advances, moving the punch 14 thereon toward the corresponding die 11 and forcing the workpiece 4' into the die bore, whereby a head 4*a* is preformed at the outer end of the workpiece 4'. With the retraction of the punch 14, a knockout pin 35 in the die 11 advances to force out the preformed workpiece 4', which is in turn gripped by the second transfer chuck 18 waiting immediately in front of the first die 11 and is transferred to the position of the second die 12. The die 12 and the punch 15 coact to form a bolt head 4*b* and a shank 4*c*. The same operation as above is thereafter repeated by the punches and dies of the subsequent stages. When a bolt blank 4'' of specified shape is formed in the final stage of the press assembly 2 and pushed out by a knockout pin 37, the blank 4'' is chucked by the transfer chuck 20 in the terminal stage and is immediately brought to a position just in front of the feed inlet 23 of the rolling mechanism 3. In this state, the press ram 17 advances, causing the pusher 24 thereon to push the blank 4'' into the starting end of the rolling portion between the rolling die 21 and the support rolling die 22. Although the rolling die 21 is already in continuous rotation at this time, the inserted blank 4'' is retained by the stopper 27 and has not been rolled yet. The starter cam 25 is rotatable with the rolling die 21, so that when a roller 44 on a cam lever 43 is forced by the action of a spring 45 into a recessed portion 25*a* of the cam 25 with the rotation of the die 21, a bellcrank 46 coupled to the cam lever 43 pivotally moves, causing the starter lever 26 to force the blank 4'' into the rolling portion 40 between the dies 21 and 22. With the blank 4'' thus forced into the rolling portion 40, the shank 4*c* of the blank 4'' is threaded as at 4*d* by the rotation of the rolling die 21. The bolt 41 thus formed by thread rolling is delivered to a specified location through a chute 42 immediately below the die 21.

Figure 5:
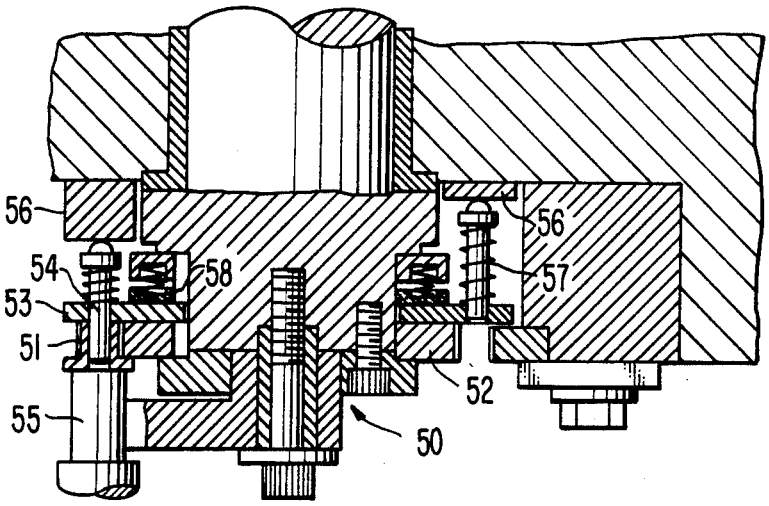
FIG. 5 is a cross sectional plan view showing another rolling mechanism embodying the invention.
Figure 6:
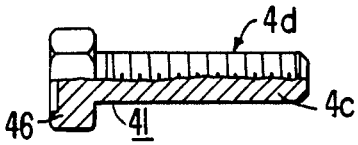
FIGS. 6 to 9 are views partly in section and showing products obtained by the apparatus of the invention.
Figure 8:
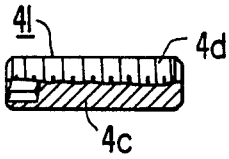
Figure 7:
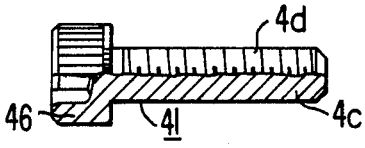
Figure 9:
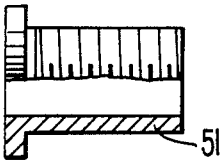

FIG. 5 shows a rolling mechanism 50 for forming by thread rolling a hollow product as seen in FIG. 9. A blank in the form of a hollow cylinder 51 is formed by the press assembly 2 and fed to the rolling mechanism 50 shown in FIG. 5. The rolling mechanism 50 includes a rolling die 52 which is provided with a disk 53 having a core rod 54 for holding the cylinder 51. Disk 53 is rotatable relative to the die 52 by slipping when subjected to resistance. Usually the disk 53 is pressed against a friction piece 58 connected to the die 52 and therefore rotatable with the die 52.

The hollow cylinder 51 formed by the press assembly is fed to the rolling mechanism 50 by being pushed and fitted around the core rod 54 by a pusher 55 during the advance of the ram. The cylinder is then pushed into a rolling portion by a starter lever for rolling operation, whereby the cylinder outer periphery is threaded. On completion of the rolling operation, the core rod 54 is retracted into a furrow portion of a cam 56 by a spring 57, permitting the product to fall off spontaneously.

According to the present invention described above, a bolt blank formed by a press assembly is pushed out from the terminal die of the press assembly and immediately fed for thread rolling directly into the inlet of a rolling die by a transfer chuck, which die is positioned adjacent to and in line with the press assembly, so that a sequential operation of press work through rolling work can be carried out at the same time with use of a single multi-stage former. Thus, blanks can be fed with high stability without resulting in an accumulation or an interruption, unlike the conventional method of gravity feeding, to assure a smooth and efficient operation for producing bolts. Because the press work is immediately followed by thread rolling work without waiting time, the heat resulting from the press work can be directly utilized for subjecting the blanks to thread rolling in an optimum temperature range as required for threading to form high-tension bolts which are resistant to fatigue. Moreover, the apparatus is compact, small sized and inexpensive, and can be installed in a reduced space.

What is claimed is:

1. A former, comprising a quill having a forward end opening and a rear portion;

means for intermittently feeding a metal material in the form of a wire rod or bar through said rear portion and out said forward end opening of said quill;

cutter means, having a blade reciprocally movable transversely of said forward end opening of said quill, for cutting the metal material into workpieces of predetermined length;

a press assembly having a ram, and a plurality of pressing stages, N in number, including a first stage and a last stage, said plurality of pressing stages being successively and equally spaced by a distance S in a single plane containing said quill, said first stage being spaced a distance equal to said distance S from said quill, said pressing stages including a plurality of dies aligned in a first line in said plane, and a plurality of punches aligned in a second line in said plane on said ram, each of said plurality of stages including corresponding ones of said plurality of dies and of said plurality of punches, said ram being reciprocally movable toward and away from said plurality of dies so as to reciprocally move the punches toward the die of each of said plurality of stages to press workpieces in said stages between said plurality of dies and said plurality of punches;

a rolling mechanism having means for rollingly shaping the periphery of said workpieces, said rolling mechanism having a rolling die for rollingly engaging the workpieces therein, and having a feed inlet immediately adjacent said rolling die in said plane along said first line a fixed distance equal to said distance S from the die of said last stage, for receiving a workpiece from said last stage;

means for reciprocally moving said ram toward and away from said plurality of dies;

means, including a plurality of workpiece engagable transfer chucks, N+1 in number, successively and equally spaced apart by a fixed distance equal to said distance S in a third line parallel said first line, and means for reciprocally moving said plurality of transfer chucks in a direction parallel said third line in synchronism with said ram moving means, for transferring in unison in said direction respective workpieces respective fixed distances equal to said distance S from said quill to said first stage, between successive ones of said plurality of stages, and between said last stage and a position aligned with said feed inlet; a pusher fixedly mounted on said ram for movement therewith, along said second line, spaced a fixed distance equal to said distance S from the punch of said last stage and aligned with said feed inlet such that said pusher pushes a workpiece at said position into said feed inlet when said ram moves toward said plurality of dies; and means, including a plurality of gears coupling said ram moving means and said rolling die, for rotating said rolling die in unison with said ram moving means such that pressing of workpieces at said plurality of stages and rolling shaping of a workpiece located in said feed inlet are initiated in synchronism and completed in synchronism.

2. A former as in claim 1, wherein said rolling mechanism further comprises a rolling portion having a starting end, peripherally of said rolling die in which the workpieces roll during said shaping; means for pushing a workpiece in said feed inlet into rolling engagement with said rolling die in said rolling portion at said starting end, said pushing means including a rolling starting cam rotatable with said rolling die and a starter lever engaging said rolling cam and pivotable by rotation of said starting cam into engagement with the workpiece in said feed inlet to push the workpiece to said starting end.

* * * * *